US007795191B2

(12) United States Patent
Colbourne

(10) Patent No.: US 7,795,191 B2
(45) Date of Patent: Sep. 14, 2010

(54) LUBRICATING OIL COMPOSITION

(75) Inventor: David Colbourne, Cheshire (GB)

(73) Assignee: Shell Oil Company, Houston, TX (US)

( * ) Notice: Subject to any disclaimer, the term of this patent is extended or adjusted under 35 U.S.C. 154(b) by 631 days.

(21) Appl. No.: 11/156,061

(22) Filed: Jun. 17, 2005

(65) Prior Publication Data

US 2006/0003902 A1 Jan. 5, 2006

(30) Foreign Application Priority Data

Jun. 18, 2004 (EP) ..... 04253657

(51) Int. Cl.
*C10L 1/22* (2006.01)
*C10M 167/00* (2006.01)

(52) U.S. Cl. ..... 508/298; 508/297; 508/243

(58) Field of Classification Search ..... 508/298, 508/297, 243
See application file for complete search history.

(56) References Cited

U.S. PATENT DOCUMENTS

| | | | | |
|---|---|---|---|---|
| 3,506,574 | A | 4/1970 | Stambaugh et al. | 252/51.5 |
| 4,111,821 | A | 9/1978 | Lazarus et al. | 252/49.9 |
| 5,102,566 | A | 4/1992 | Fetterman, Jr. et al. | 252/32.7 |
| 6,114,288 | A * | 9/2000 | Fujitsu et al. | 508/371 |
| 6,124,249 | A * | 9/2000 | Seebauer et al. | 508/469 |
| 6,204,224 | B1 | 3/2001 | Quintero et al. | 507/123 |
| 6,331,510 | B1 | 12/2001 | Curtis et al. | 508/578 |
| 6,372,696 | B1 | 4/2002 | Tipton | 508/110 |
| 2002/0151445 | A1 | 10/2002 | Curtis et al. | 508/578 |
| 2002/0155958 | A1 * | 10/2002 | Dunn et al. | 508/398 |

FOREIGN PATENT DOCUMENTS

| | | |
|---|---|---|
| EP | 668342 | 8/1995 |
| EP | 750031 | 12/1996 |
| EP | 776959 | 6/1997 |
| EP | 1167497 | 1/2002 |
| WO | 97/21788 | 6/1997 |
| WO | 99/20720 | 4/1999 |
| WO | 99/41335 | 8/1999 |
| WO | 00/08115 | 2/2000 |
| WO | 00/14179 | 3/2000 |
| WO | 00/14183 | 3/2000 |
| WO | 00/14187 | 3/2000 |
| WO | 00/14188 | 3/2000 |
| WO | 00/15736 | 3/2000 |
| WO | 01/18156 | 3/2001 |
| WO | 01/57166 | 8/2001 |

* cited by examiner

*Primary Examiner*—Walter D Griffin
*Assistant Examiner*—Frank C Campanell

(57) ABSTRACT

Lubricating oil composition having a sulphur content of from 0.01 to 0.3 wt. %, a phosphorus content of from 0.01 to 0.1 wt. % and a sulphated ash content of from 0.1 to 1.2 wt. %, based on the total weight of the lubricating oil composition is provided. The lubricating oil composition contains a mineral and/or synthetic base oil and one or more compounds of formula I, (I)

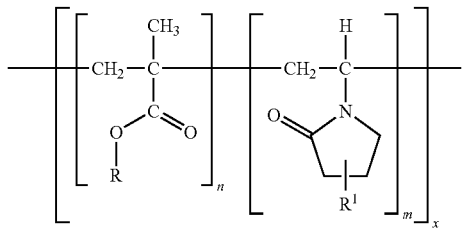

wherein R is an optionally substituted branched or straight chain alkyl group containing from 3 to 50 carbon atoms; $R^1$ is hydrogen or an optionally substituted branched or straight chain alkyl group containing from 1 to 50 carbon atoms; n is an integer equal to or greater than 1, and m is also an integer equal to or greater than 1; and X is an integer from 2 to 10,000. A method of improving engine cleanliness in diesel, gas-fuelled or gasoline engine applications using such composition is also provided.

13 Claims, No Drawings

LUBRICATING OIL COMPOSITION

FIELD OF THE INVENTION

The present invention relates to a lubricating oil composition.

BACKGROUND OF THE INVENTION

Due to environmental considerations, exhaust after-treatment devices are often fitted to vehicles in order to reduce particulate matter and $NO_x$ emissions therefrom.

However, the sulphated ash, sulphur and phosphorus concentrations of lubricating oil compositions conventionally used in internal combustion engines may have adverse effects on such after-treatment devices.

Sulphated ash is the total weight percent of ash in a lubricating oil composition. The sulphated ash content in a lubricating oil composition is related to the total metal content therein. Sulphated ash may be conveniently measured according to ASTM D874.

In view of the adverse affects that the sulphated ash, sulphur and phosphorus concentrations of lubricating oil compositions may have on exhaust after-treatment devices, it is therefore prudent to develop lubricating oil compositions with reduced sulphated ash, sulphur and/or phosphorus concentrations therein.

Phosphorus concentrations may be generally reduced by reducing the amount of zinc dithiophosphate which is present as an anti-wear additive in lubricating oil compositions.

Sulphur levels in lubricating oil compositions may be reduced by employing low sulphur level base oils and reducing the amount of sulphur-containing additives employed therein.

The major sources of sulphated ash in a lubricating oil composition are generally any metal detergent additives and zinc dithiophosphate anti-wear additives that are employed therein.

Metal detergent additives perform several roles including acting as a cleaning agent on metal engine surfaces, neutralising acids and providing anti-oxidant properties to the lubricating oil composition.

However, reduction of the amount of metal detergent additives in a lubricating oil composition has an adverse effect on the detergency thereof.

SUMMARY OF THE INVENTION

A lubricating oil composition having a sulphur content of from 0.01 to 0.3 wt. %, a phosphorus content of from 0.01 to 0.1 wt. % and a sulphated ash content of from 0.1 to 1.2 wt. %, based on the total weight of the lubricating oil composition, comprising a mineral and/or synthetic base oil and at least one compound of formula I, (I)

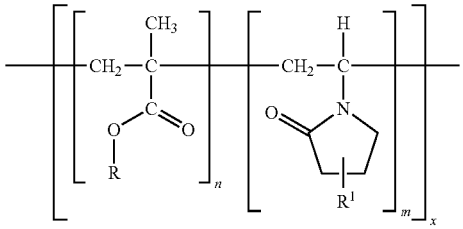

wherein R is an alkyl group containing from 3 to 50 carbon atoms; $R^1$ is hydrogen or an alkyl group containing from 1 to 50 carbon atoms; n is an integer equal to or greater than 1, and m is an integer equal to or greater than 1; and X is an integer from 2 to 10,000.

In another embodiment, a method of lubricating an internal combustion engine using the lubricating oil composition is provided.

DETAILED DESCRIPTION OF THE INVENTION

It is therefore highly desirable to be able to develop lubricating oil compositions having low sulphated ash, sulphur and phosphorus concentrations which also have good detergency and which give rise to beneficial engine cleanliness such as piston cleanliness.

U.S. Pat. No. 4,111,821 discloses a lubricant composition for use in reciprocating gas compressors.

Said composition is said to contain from about 97% to 99% by weight of a phthalate ester of an aliphatic alcohol having 10 to 15 carbon atoms and 1% to 3% by weight of an additive system that contains (a) a viscosity index modifier to increase the viscosity or the viscosity index of the base fluid, (b) an antioxidant component, and (c) a corrosion inhibitor and/or a load carrying additive.

U.S. Pat. No. 3,506,574 describes lubricating and fuel compositions which comprise N-vinyl pyrrolidone graft copolymers. Said copolymers are said to impart such beneficial properties as dispersancy, improvements in viscosity, viscosity-temperature relationships and pour point depressing action.

U.S. Ser. No. 2002/0151445 A1 discloses a synthetic-based lubricant, particularly for use in heavy duty diesel engines, which lubricant comprises (a) a synthetic base oil composition, said base oil having a kinematic viscosity of at least $4.8\times10^{-6}$ $m^2/S$ (4.8 cSt) at 100° C. and a viscosity index of at least 110; (b) a dispersant-viscosity modifier; and (c) a sulphur-free functionalised hydrocarbyl (or alkyl) phenol detergent.

U.S. Pat. No. 5,102,566 describes low sulphated ash lubricating oil compositions which are said to show a marked reduction in engine carbon deposits.

Such lubricating oil compositions comprise an oil of lubricating viscosity as the major component and as the minor component (A) at least about 2 wt. % of at least one high molecular weight ashless dispersant, (B) an antioxidant effective amount of at least one oil soluble antioxidant, and (C) at least one oil soluble dihydrocarbyl dithiophosphate antiwear material, wherein the lubricating oil composition is characterised by a total sulphated ash (SASH) level as measured by ASTM D874 of less than about 0.6 wt. % SASH and by a SASH wt.:ashless dispersant wt. ratio of from about 0.01 to about 0.2:1.

It is indicated in U.S. Pat. No. 5,102,566 that lubricating oil compositions can comprise several different types of additives that will supply the characteristics that are required in the compositions.

Hence, U.S. Pat. No. 5,102,566 specifies that these additives include viscosity index improvers, antioxidants, corrosion inhibitors, detergents, pour point depressants, anti-wear agents, provided that the fully formulated lubricating oil composition has a total sulphated ash (SASH) level as measured by ASTM D874 of less than about 0.6 wt. % SASH.

Viscosity index improvers are added to lubricating oil compositions in order to reduce the extent of viscosity changes with temperature.

In this regard, U.S. Pat. No. 5,102,566 indicates that said lubricating oil compositions can be used with viscosity index improvers to form multi-grade diesel engine lubricating oils.

The viscosity index improvers that may be generally used in the compositions of U.S. Pat. No. 5,102,566 are said to be high molecular weight hydrocarbon polymers including esters, which may also be derivatised to include other properties or functions, such as the addition of dispersancy properties.

Whilst the formulations tested in U.S. Pat. No. 5,102,566 are detailed in amounts of vol. %, reasonable approximations of said amounts to amounts in wt. % can be made by assuming that the amounts in wt. % will not be less than that vol. % for the additives/components.

The formulation of Comparative Example A in U.S. Pat. No. 5,102,566 has a SASH content of 0.85 vol. %. Said formulation comprises an ethylene-propylene copolymer viscosity index improver in order to adjust the viscosity index of the formulation.

It will be appreciated by the skilled person that the phosphorus level in the formulation of Comparative Example A is still relatively high (approximately 0.12 to 0.13 wt. %) and the sulphur content from the additives in said formulation is approximately 0.4 wt. % (approximately 0.14 wt. % from the antioxidant, 0.24 wt. % from the zinc dialkyl dithiophosphate and 0.02 wt. % from the sulphonate detergent). The sulphur content in the formulation will be further increased by the additional contributions of sulphur present in the base oil and the carrier oils used for the additives. It is not possible to calculate the additional contributions these oils will make to the overall sulphur content of the formulation of Comparative Example A from the information given.

The formulation of Example 1 in U.S. Pat. No. 5,102,566 has a SASH content of 0.44 vol. %. Said formulation comprises an ethylene-propylene copolymer viscosity index improver in order to adjust the viscosity index of the formulation.

Whilst the formulation of Example 1 of U.S. Pat. No. 5,102,566 has a lower phosphorus content (approximately 0.09 to 0.10% wt.) than the formulation of Comparative Example A, said formulation still has a high sulphur content from the additives therein (approximately 0.33 wt. %, i.e. approximately 0.14 wt. % from the antioxidant, 0.18 wt. % from the zinc dialkyl dithiophosphate and 0.01 wt. % from the sulphonate detergent). As with the formulation of Comparative Example A, the sulphur content in the formulation of Example 1 will be further increased by the additional contributions of sulphur present in the base oil and the carrier oils used for the additives. It is not possible to calculate the additional contributions these oils will make to the overall sulphur content of the formulation of Example 1 from the information given.

The formulation of Example 2 in U.S. Pat. No. 5,102,566 has a SASH content of 0.5 vol. %. Said formulation comprises a nitrogen-containing ethylene-propylene copolymer dispersant viscosity index improver in order to adjust the viscosity index of the formulation.

No information is provided in U.S. Pat. No. 5,102,566 on the precise zinc dialkyl dithiophosphate used in Example 2. It therefore not possible to calculate the sulphur and phosphorus contributions to the formulation therefrom. However, given the overall sulphated ash level of said formulation and the amount of sulphonate detergent therein, the overall phosphorus and sulphur content in said formulation will be similar to that in the formulation of Example 1.

Whilst U.S. Pat. No. 5,102,566 tests the crownland cleanliness for the formulations of Comparative Example A and Example 1, the formulation of Example 2 is not tested therein.

EP-A-1167497 discloses a lubricating oil composition having a sulphur content of 0.01 to 0.3 wt. % and a phosphorus content of 0.01 to 0.1 wt. %, and giving a sulphated ash content in the range of 0.1 to 1 wt. %, which is said to have good high temperature detergency, and which comprises:

a) a major amount of a mineral base oil having a sulphur content of at most 0.1 wt. %;
b) an ashless dispersant comprising an alkenyl- or alkylsuccinimide or a derivative thereof in an amount of 0.01 to 0.3 wt. % in terms of a nitrogen atom content;
c) a metal-containing detergent containing an organic acid metal salt which is selected from the group consisting of a non-sulphurised alkali metal or alkaline earth metal salt of an alkylsalicylic acid having a TBN of 10 to 350 mg.KOH/g and a non-sulphurised alkali metal or alkaline earth metal salt of an alkylphenol derivative having a Mannich base structure, in an amount of 0.1 to 1 wt. % in terms of a sulphated ash content;
d) a zinc dialkyldithiophosphate in an amount of 0.01 to 0.1 wt. % in terms of a phosphorus content; and
e) an oxidation inhibitor selected from the group consisting of a phenol compound and an amine compound in an amount of 0.01 to 5 wt. %.

Said composition may comprise further additives such as hydrated alkali metal borate, molybdenum compounds and viscosity index improvers.

The viscosity index improvers which may be optionally added to the compositions of EP-A-1167497 are said to include polyalkylmethacrylates, ethylene-propylene copolymers, styrene butadiene copolymers, polyisoprenes and dispersant type or multi-functional type viscosity index improvers.

In this regard, the examples of EP-A-1167497 employ a ethylene-propylene copolymer as a non-dispersant type viscosity index improver in order to alter the viscosity grade of the formulations tested to SAE (Society of Automotive Engineers) Grade 10W30.

It has now been found in the present invention that the addition of one or more specific viscosity index improvers to lubricating oil compositions having reduced levels of sulphated ash, sulphur and/or phosphorus, results in lubricating oil compositions having good detergency and which give rise to beneficial engine cleanliness such as piston cleanliness, while maintaining engine durability through excellent wear protection and antioxidancy performance.

Accordingly, the present invention provides a lubricating oil composition having a sulphur content of in the range of from 0.01 to 0.3 wt. %, a phosphorus content in the range of from 0.01 to 0.1 wt. % and a sulphated ash content in the range of from 0.1 to 1.2 wt. %, based on the total weight of the lubricating oil composition, which comprises a mineral and/or synthetic base oil and one or more compounds of formula I, (I)

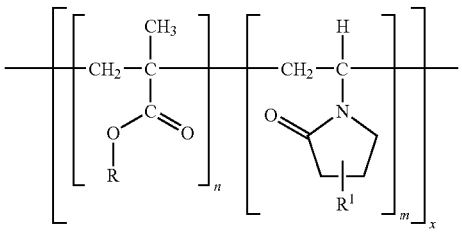

wherein R is an optionally substituted branched or straight chain alkyl group containing from 3 to 50 carbon atoms; $R^1$ is hydrogen or an optionally substituted branched or straight chain alkyl group containing from 1 to 50 carbon atoms; n is an integer equal to or greater than 1, and m is also an integer equal to or greater than 1; and X is an integer from 2 to 10,000.

The one or more compounds of formula I are preferably present in an amount in the range of from 0.01 to 10.00 wt. %, more preferably in the range of from 0.1 to 8.0 wt. % and most preferably in the range of from 1.0 to 3.0 wt. %, based on the total weight of the lubricating oil composition.

In a preferred embodiment of the present invention, R is an optionally substituted branched or straight chain alkyl group containing from 4 to 49 carbon atoms, more preferably from 6 to 40 carbon atoms; $R^1$ is hydrogen or an optionally substituted branched or straight chain alkyl group containing from 3 to 50 carbon atoms, more preferably from 4 to 49 carbon atom, even more preferably from 6 to 40 carbon atoms; and X is an integer from 10 to 9,000, more preferably from 20 to 8,000.

In the present invention, the phrase "optionally substituted branched or straight chain alkyl group" is used to describe alkyl groups optionally containing one or more "inert" heteroatom-containing functional groups.

By "inert" is meant that the functional groups do not interact to any substantial degree with the other components of the lubricating oil composition. Non-limiting examples of such inert groups are amines and halides, such as fluoride and chloride.

Examples of compounds of formula I include those described in U.S. Pat. No. 6,331,510, U.S. Pat. No. 6,204,224 and U.S. Pat. No. 6,372,696. Compounds of formula I include those available ex. Rohmax under the trade designations "Acryloid 985", "Viscoplex 6-054", "Viscoplex 6-954" and "Viscoplex 6-565" and that available ex. The Lubrizol Corporation under the trade designation "LZ 7720C".

Compounds of formula I may be conveniently prepared by conventional methods. In particular, said compounds may be prepared according to the methods described in U.S. Pat. No. 3,506,574 and EP-A2-0750031.

The lubricating oil composition may comprise a single zinc dithiophosphate or a combination of two or more zinc dithiophosphates, the or each zinc dithiophosphate being selected from zinc dialkyl-, diaryl- or alkylaryl-dithiophosphates, provided that the total phosphorus content of the lubricating oil composition is in the range of from 0.01 to 0.1 wt. %.

Zinc dithiophosphate is a well known additive in the art and may be conveniently represented by general formula II;

(II)

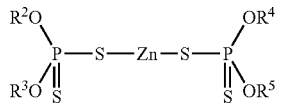

wherein $R^2$ to $R^5$ may be the same or different and are each a primary alkyl group containing from 1 to 20 carbon atoms preferably from 3 to 12 carbon atoms, a secondary alkyl group containing from 3 to 20 carbon atoms, preferably from 3 to 12 carbon atoms, an aryl group or an aryl group substituted with an alkyl group, said alkyl substituent containing from 1 to 20 carbon atoms preferably 3 to 18 carbon atoms.

Zinc dithiophosphate compounds in which $R^2$ to $R^5$ are all different from each other can be used alone or in admixture with zinc dithiophosphate compounds in which $R^2$ to $R^5$ are all the same.

Preferably, the or each zinc dithiophosphate used in the present invention is a zinc dialkyl dithiophosphate.

Suitable zinc dithiophosphates which are commercially available include primary zinc dithiophosphates such as those available ex. Lubrizol Corporation under the trade designations "Lz 1097" and "Lz 1395", those available ex. Chevron Oronite under the trade designations "OLOA 267" and "OLOA 269R", and that available ex. Ethyl under the trade designation "HITEC 7197"; secondary zinc dithiophosphates such as those available ex. Lubrizol Corporation under the trade designations "Lz 677A", "Lz 1095" and "Lz 1371", that available ex. Chevron Oronite under the trade designation "OLOA 262" and that available ex. Ethyl under the trade designation "HITEC 7169"; and aryl type zinc dithiophosphates such as those available ex. Lubrizol Corporation under the trade designations "Lz 1370" and "Lz 1373" and that available ex. Chevron Oronite under the trade designation "OLOA 260".

The lubricating oil composition according to the present invention may generally comprise in the range of from 0.1 to 1.0 wt. % of zinc dithiophosphate, (if primary or secondary alkyl type), preferably in the range of from 0.2 to 0.8 wt. % and most preferably in the range of from 0.4 to 0.7 wt. %, based on total weight of the lubricating oil composition.

The amount of phosphorus in the lubricating oil composition of the present invention is therefore generally in the range of from 0.01 to 0.10 wt. %, preferably in the range of from 0.02 to 0.08 wt. %, most preferably in the range of from 0.04 to 0.07 wt. %.

At phosphorus levels of 0.01 wt. % and below, there is insufficient anti-wear performance. At phosphorus levels of 0.1 wt. % and above, the phosphorus may have a detrimental effect on vehicle after-treatment devices.

The lubricating oil composition of the present invention generally has a sulphated ash content in the range of from 0.1 to 1.2 wt. %, preferably in the range of from 0.3 to 1.2 wt. %, more preferably in the range of from 0.5 to 1.1 wt. % and most preferably in the range of from 0.6 to 1.0 wt. %, based on the total weight of the lubricating oil composition.

The lubricating oil composition of the present invention generally has a sulphur content in the range of from 0.01 to 0.3 wt. %, preferably in the range of from 0.06 to 0.3 wt. %, more preferably in the range of from 0.1 to 0.25 wt. % and most preferably in the range of from 0.12 to 0.20 wt. %, based on the total weight of the lubricating oil composition.

Preferred compositions according to the present invention have one or more of the following features:

(i) greater than 0.01 wt. % of phosphorus;
(ii) greater than 0.035 wt. % of phosphorus;
(iii) at least 0.035 wt. % of phosphorus;
(iv) less than 0.07 wt. % of phosphorus;
(v) less than 0.10 wt. % of phosphorus;
(vi) at most 0.08 wt. % of phosphorus;
(vii) not greater than 1.0 wt. % of sulphated ash;
(viii) not greater than 0.9 wt. % of sulphated ash;
(ix) not greater than 0.7 wt. % of sulphated ash;
(x) not greater than 0.3 wt. % of sulphur;
(xi) not greater than 0.1 wt. % of sulphur; and
(xii) not greater than 0.05 wt. % of sulphur, based on the total weight of the lubricating oil composition.

Particularly preferred compositions according to the present invention are:—

(A): those having features (i) and (iv); those having features (i) and (v); those having features (i) and (vi); those having features (ii) and (iv); those having features (ii) and (v);

those having features (ii) and (vi); those having features (iii) and (iv); those having features (iii) and (v); and those having features (iii) and (vi);

(B): those having features (i), (iv) and (vii); those having features (i), (iv) and (viii); those having features (i), (iv) and (ix); those having features (i), (v) and (vii); those having features (i), (v) and (viii); those having features (i), (v) and (ix); those having features (i), (vi) and (vii); those having features (i), (vi) and (viii); those having features (i), (vi) and (ix); those having features (ii), (iv) and (vii); those having features (ii), (iv) and (viii); those having features (ii), (iv) and (ix); those having features (ii), (v) and (vii); those having features (ii), (v) and (viii); those having features (ii), (v) and (ix); those having features (ii), (vi) and (vii); those having features (ii), (vi) and (viii); those having features (ii), (vi) and (ix); those having features (iii), (iv) and (vii); those having features (iii), (iv) and (viii); those having features (iii), (iv) and (ix); those having features (iii), (v) and (vii); those having features (iii), (v) and (viii); those having features (iii), (v) and (ix); those having features (iii), (vi) and (vii); those having features (iii), (vi) and (viii); and those having features (iii), (vi) and (ix);

(C): those having features (i), (iv) and (x); those having features (i), (iv) and (xi); those having features (i), (iv) and (xii); those having features (i), (v) and (x); those having features (i), (v) and (xi); those having features (i), (v) and (xii); those having features (i), (vi) and (x); those having features (i), (vi) and (xi); those having features (i), (vi) and (xii); those having features (ii), (iv) and (x); those having features (ii), (iv) and (xi); those having features (ii), (iv) and (xii); those having features (ii), (v) and (x); those having features (ii), (v) and (xi); those having features (ii), (v) and (xii); those having features (ii), (vi) and (x); those having features (ii), (vi) and (xi); those having features (ii), (vi) and (xii); those having features (iii), (iv) and (x); those having features (iii), (iv) and (xi); those having features (iii), (iv) and (xii); those having features (iii), (v) and (x); those having features (iii), (v) and (xi); those having features (iii), (v) and (xii); those having features (iii), (vi) and (x); those having features (iii), (vi) and (xi); and those having features (iii), (vi) and (xii); and (D): those having features (i), (iv), (vii) and (x); those having features (i), (iv), (viii) and (x); those having features (i), (iv), (ix) and (x); those having features (i), (v), (vii) and (x); those having features (i), (v), (viii) and (x); those having features (i), (v), (ix) and (x); those having features (i), (vi), (vii) and (x); those having features (i), (vi), (viii) and (x); those having features (i), (vi), (ix) and (x); those having features (ii), (iv), (vii) and (x); those having features (ii), (iv), (viii) and (x); those having features (ii), (iv), (ix) and (x); those having features (ii), (v), (vii) and (x); those having features (ii), (v), (viii) and (x); those having features (ii), (v), (ix) and (x); those having features (ii), (vi), (vii) and (x); those having features (ii), (vi), (viii) and (x); those having features (ii), (vi), (ix) and (x); those having features (iii), (iv), (vii) and (x); those having features (iii), (iv), (viii) and (x); those having features (iii), (iv), (ix) and (x); those having features (iii), (v), (vii) and (x); those having features (iii), (v), (viii) and (x); those having features (iii), (v), (ix) and (x); those having features (iii), (vi), (vii) and (x); those having features (iii), (vi), (viii) and (x); those having features (iii), (vi), (ix) and (x); those having features (i), (iv), (vii) and (xi); those having features (i), (iv), (viii) and (xi); those having features (i), (iv), (ix) and (xi); those having features (i), (v), (vii) and (xi); those having features (i), (v), (viii) and (xi); those having features (i), (v), (ix) and (xi); those having features (i), (vi), (vii) and (xi); those having features (i), (vi), (viii) and (xi); those having features (i), (vi), (ix) and (xi); those having features (ii), (iv), (vii) and (xi); those having features (ii), (iv), (viii) and (xi); those having features (ii), (iv), (ix) and (xi); those having features (ii), (v), (vii) and (xi); those having features (ii), (v), (viii) and (xi); those having features (ii), (v), (ix) and (xi); those having features (ii), (vi), (vii) and (xi); those having features (ii), (vi), (viii) and (xi); those having features (ii), (vi), (ix) and (xi); those having features (iii), (iv), (vii) and (xi); those having features (iii), (iv), (viii) and (xi); those having features (iii), (iv), (ix) and (xi); those having features (iii), (v), (vii) and (xi); those having features (iii), (v), (viii) and (xi); those having features (iii), (v), (ix) and (xi); those having features (iii), (vi), (vii) and (xi); those having features (iii), (vi), (viii) and (xi); those having features (iii), (vi), (ix) and (xi); those having features (i), (iv), (vii) and (xii); those having features (i), (iv), (viii) and (xii); those having features (i), (iv), (ix) and (xii); those having features (i), (v), (vii) and (xii); those having features (i), (v), (viii) and (xii); those having features (i), (v), (ix) and (xii); those having features (i), (vi), (vii) and (xii); those having features (i), (vi), (viii) and (xii); those having features (i), (vi), (ix) and (xii); those having features (ii), (iv), (vii) and (xii); those having features (ii), (iv), (viii) and (xii); those having features (ii), (iv), (ix) and (xii); those having features (ii), (v), (vii) and (xii); those having features (ii), (v), (viii) and (xii); those having features (ii), (v), (ix) and (xii); those having features (ii), (vi), (vii) and (xii); those having features (ii), (vi), (viii) and (xii); those having features (ii), (vi), (ix) and (xii); those having features (iii), (iv), (vii) and (xii); those having features (iii), (iv), (viii) and (xii); those having features (iii), (iv), (ix) and (xii); those having features (iii), (v), (vii) and (xii); those having features (iii), (v), (viii) and (xii); those having features (iii), (v), (ix) and (xii); those having features (iii), (vi), (vii) and (xii); those having features (iii), (vi), (viii) and (xii); and those having features (iii), (vi), (ix) and (xii).

The base oil used in the present invention may be a mineral or a synthetic base oil, or a mixture thereof.

The amount of base oil incorporated in the lubricating oil composition of the present invention is preferably present in an amount in the range of from 60 to 98 wt. %, more preferably in an amount in the range of from 75 to 90 wt. %, with respect to the total weight of the lubricating oil composition.

Mineral base oils include liquid petroleum oils and solvent-treated or acid-treated mineral lubricating oil of the paraffinic, naphthenic, or mixed paraffinic/naphthenic type which may be further refined by hydrofinishing processes and/or dewaxing.

Naphthenic base oils have low viscosity index (VI) (generally 40-80) and a low pour point. Such base oils are produced from feedstocks rich in naphthenes and low in wax content and are used mainly for lubricants in which colour and colour stability are important, and VI and oxidation stability are of secondary importance.

Paraffinic base oils have higher VI (generally >95) and a high pour point. Said base oils are produced from feedstocks rich in paraffins, and are used for lubricants in which VI and oxidation stability are important.

Synthetic processes enable molecules to be built from simpler substances or to have their structures modified to give the precise properties required.

Synthetic base oils include hydrocarbon oils such as olefin oligomers (PAOs), dibasic acids esters, poly esters, and dewaxed waxy raffinate. Synthetic hydrocarbon base oils sold by the Royal Dutch/Shell Group of Companies under the designation "XHVI" (trade mark) may be conveniently used.

Preferred base oils include those obtained by producing heavy linear chain paraffins in the Fischer-Tropsch process where hydrogen and carbon monoxide obtained by the gasification process (partial oxidation) of natural gas (methane etc.) are used and then subjecting this material to a catalytic cracking and isomerisation process.

Such Fischer-Tropsch derived base oils may conveniently be any Fischer-Tropsch derived base oil as disclosed in for example EP-A-776959, EP-A-668342, WO-A-97/21788, WO-A-00/15736, WO-A-00/14188, WO-A-00/14187, WO-A-00/14183, WO-A-00/14179, WO-A-00/08115, WO-A-99/41332, EP-A-1029029, WO-A-01/18156 and WO-A-01/57166.

Preferably, the base oil is constituted from mineral oils and/or synthetic base oils which contain more than 80% wt. of saturates, preferably more than 90% wt., as measured according to ASTM D2007.

It is further preferred that the base oil has a sulphur content of at most 0.15 wt. %, more preferably at most 0.1 wt. %, further preferably at most 0.03 wt. % and most preferably at most 0.005 wt. %, calculated as elemental sulphur and measured according to ASTM D2622, ASTM D4294, ASTM D4927 or ASTM D3120.

Preferably, the viscosity index of base oil is more than 80, more preferably more than 100 and most preferably more than 120, as measured according to ASTM D2270.

Preferably, the lubricating oil composition has a kinematic viscosity at 100° C. in the range of from 2 to 20 $mm^2/s$, more preferably in the range of from 3 to 16 $mm^2/s$, most preferably in the range of from 4 to 10 $mm^2/s$.

In addition, detergents, metal deactivators, ashless anti-wear agents, ashless dispersants, such as succinimides, and/or ashless anti-oxidants may also be present in the lubricating oil composition of the present invention.

Typical ashless dispersants that may be conveniently employed in the lubricating oil composition of the present invention, include alkenyl- or alkyl-succinimides or derivatives thereof. Said ashless dispersants may be borated. Ashless dispersants that may be conveniently employed in the lubricating oil composition of the present invention include those described in EP-A-1167497.

Typical detergents that may be conveniently used include one or more salicylate and/or phenate and/or sulphonate detergents. Alkali metal and/or alkaline earth metal-based detergents are particularly preferred.

The detergent may also conveniently be a non-sulphurised alkali metal or alkaline earth metal salt of an alkylphenol derivative having a Mannich base structure, as described in EP-A-1167497.

However, as mentioned above, the metal organic and inorganic base salts which are used as detergents can contribute to the sulphated ash content of a lubricating composition. Hence, the amounts of such additives employed in the lubricating oil composition of the present invention are to be minimised such that the total sulphated ash content of the lubricating oil composition is in the range of from 0.1 to 1 wt. %, based on the total weight of the lubricating oil composition.

In order to maintain the total sulphated ash content of the lubricating oil composition of the present invention in the range of from 0.1 to 1 wt. %, said detergents are preferably used in amounts in the range of 0.05 to 12.5 wt. %, more preferably from 1.0 to 9.0 wt. % and most preferably in the range of from 2.0 to 5.0 wt. %, based on the total weight of the lubricating oil composition.

Furthermore, it is preferred that said detergents, independently, have a TBN (total base number) value in the range of from 10 to 400 mg.KOH/g, more preferably in the range of from 30 to 350 mg.KOH/g and most preferably in the range of 50 to 300 mg.KOH/g, as measured by ASTM D2896.

With reference to measurements by ASTM D4739, it is preferred that said detergents, independently, have a TBN (total base number) value in the range of from 8 to 400 mg.KOH/g, more preferably in the range of from 25 to 350 mg.KOH/g and most preferably in the range of 45 to 300 mg.KOH/g.

The TBN value of the lubricating oil composition of the present invention is preferably in the range of from 5.0 to 12.0 mg.KOH/g, more preferably in the range of from 6.0 to 11.5 mg.KOH/g, even more preferably in the range of from 7.0 to 11.0 mg.KOH/g and most preferably in the range of 6.0 to 10.0 mg.KOH/g, as measured by ASTM D2896.

With reference to measurements by ASTM D4739, the TBN value of the lubricating oil composition of the present invention is preferably in the range of from 4 to 11 mg.KOH/g, more preferably in the range of from 5 to 10.5 mg.KOH/g and most preferably in the range of 5 to 9.5 mg.KOH/g.

In order to maintain a low total sulphur level in the lubricating oil composition of the present invention, as hereinbefore described, i.e. generally in the range of from 0.01 to 0.3 wt. %, salicylate detergents are preferred.

Thus, in a preferred embodiment, the lubricating oil composition of the present invention may comprise one or more salicylate detergents, for example, said salicylate detergents may conveniently be alkaline earth metal salicylates.

Said salicylate detergents may be conveniently added in an amount in the range of from 1.0 to 10.0 wt. %, more preferably from 2.0 to 5.0 wt. %, based on the total weight of lubricating oil composition.

In addition to acting as an anti-wear agent, zinc dithiophosphate also acts as an anti-oxidant.

Consequently, in view of the low phosphorus content of the lubricating oil of the present invention which may, for example, arise from the presence of zinc dithiophosphate therein, in a preferred embodiment, one or more supplementary anti-oxidants may be conveniently added to the lubricating oil compositions of the present invention.

Said supplementary anti-oxidants may be conveniently added in an amount in the range of from 0.001 to 5.0 wt. %, preferably from 0.005 to 4.0 wt. %, more preferably from 0.01 to 3.0 wt. %, based on the total weight of lubricating oil composition.

In a preferred embodiment, the lubricating oil composition of the present invention comprises one or more phenolic and/or aminic anti-oxidants.

Suitable supplementary anti-oxidants include phenolic compounds such as that available ex. Ciba Specialty Chemicals Co. under the trade designation "Irganox L-135"; and aminic compounds such as diphenyl amines, for example, that available ex. Ciba Specialty Chemicals Co. under the trade designation "Irganox L-57" and phenyl naphthyl amines.

The lubricating oil compositions of the present invention may be conveniently prepared by admixing the one or more compounds of formula I and, optionally, one or more further additives that are usually present in lubricating oils, for example, one or more anti-wear agents, one or more detergents and/or one or more anti-oxidants, with a mineral and/or synthetic base oil.

The lubricating oil composition according to the present invention may contain further additives that are usually present in lubricating oil compositions, such as friction modifiers, pour point depressants, anti-foam agents, supplementary viscosity index modifiers and demulsifiers.

Pour point depressants generally are high molecular weight polymers such as alkylaromatic polymers and polymethacrylates. As anti-foam agents, silicone polymers and/or polymethacrylates are generally used. Demulsifiers which are generally applied are polyalkylene glycol ethers.

Lubricating oil compositions of the present invention display good detergency and give rise to beneficial engine cleanliness such as piston cleanliness.

Furthermore, said lubricating oil compositions maintain engine durability through excellent wear protection and anti-oxidancy performance.

Accordingly, the present invention further provides for the use of a lubricating oil composition according to the present invention as a crankcase lubricant in order to improve engine cleanliness such as piston cleanliness in diesel, gas-fuelled and/or gasoline engine applications.

Said piston cleanliness is conveniently demonstrated by the Daimler-Chrysler OM441LA (CEC 1-52-T-97) and MAN Meistersinger (MAN Test Method Meistersinger II) tests.

In a preferred embodiment of the present invention there is provided, the use of a lubricating oil composition according to the present invention as a crankcase lubricant in order to meet the piston cleanliness requirements of the Daimler-Chrysler performance specification for heavy duty diesel engine oils, MB 228.5.

There is further provided in the present invention, the use of one or more compounds of formula I in a lubricating oil composition, in particular a crankcase lubricant, in order to meet the piston cleanliness requirements of the Daimler-Chrysler performance specification for heavy duty engine oils, MB 228.5.

The present invention further provides a method of lubricating an internal combustion engine, in particular a diesel engine, gasoline engine and a gas-fuelled engine, with a lubricating oil composition as hereinbefore described. This includes engines equipped with exhaust gas recirculation (EGR).

Hitherto, it has been considered in the art that lubricating oil compositions having higher TBN values (i.e. of at least 10.0 mg.KOH/g by ASTM D4739, equating to greater than 11.0 mg. KOH/g by ASTM D2896) are required to adequately lubricate EGR engines because of the acidic gases being fed back into the inlet system.

However, the lubricating oil composition of the present invention exhibits surprisingly good piston cleanliness, wear protection and anticorrosion performance in EGR engines, despite, in a preferred embodiment having a TBN value in the range of from 5.0 to 9.5 mg.KOH/g (ASTM D4739).

In particular, lubricating oil compositions according to the present invention surprisingly pass the API CI-4 requirements (ASTM D4485-03a; Standard Specification for Performance of Engine Oils) despite having the afore-mentioned sulphur content, phosphorus content, sulphated ash content and TBN values.

Hitherto, it has also been considered in the art that lubricating oil compositions having higher sulphated ash (i.e. of at least 1.4 wt. % by ASTM D874) and TBN (i.e. of at least 12 by ASTM D2896) values are required to adequately provide the piston cleanliness and wear protection associated with extended oil drain intervals, particularly for heavy duty diesel engines.

However, the lubricating oil composition of the present invention exhibits surprisingly good piston cleanliness, wear protection and anticorrosion performance in Daimler-Chrysler and MAN engines, despite, in a preferred embodiment having sulphated ash values in the range of 0.6 to 1.0 (ASTM D874) and TBN values in the range of from 5.0 to 9.5 mg.KOH/g (ASTM D4739).

In particular, lubricating oil compositions according to the present invention surprisingly pass the requirements of ACEA E4, DC 228.5 and MAN M3277 performance specifications despite having the afore-mentioned sulphur content, phosphorus content, sulphated ash content and TBN values.

Accordingly, in preferred embodiments of the present invention, there is provided the use of a lubricating oil composition according to the present invention as a crankcase lubricant in order to improve engine cleanliness and durability in engine applications optionally including EGR (exhaust gas recirculation). Said piston cleanliness in non-EGR engines may be conveniently demonstrated by the Daimler-Chrysler OM441LA test. Said durability in EGR engines may be conveniently demonstrated in the Mack T10 test.

In a further embodiment, there is provided a method of lubricating an internal combustion engine, in particular a diesel engine, a gasoline engine and a gas-fuelled engine, wherein said engine has EGR (exhaust gas recirculation), with a lubricating oil composition as hereinbefore described.

The present invention will now be illustrated by the following Examples, which should not be regarded as limiting the scope of the present invention in any way.

EXAMPLES

In the Examples, the various additives are designated as follows:—

(a) Viscosity Index Improver Compound According to Formula I

"Viscoplex 6-054" which is marketed ex. Rohmax as a viscosity index improver was employed. Said additive does not contain sulphated ash and phosphorus and is an alkyl methacrylate/N-vinylpyrrolidinone copolymer.

(b) Zinc Dithiophosphate Anti-Wear Agent

A secondary C3-6 zinc dithiophosphate (ZnDTP) available ex. Lubrizol Corporation under the trade designation "Lz 1371" was used.

(c) Anti-Oxidant

Phenolic anti-oxidant available ex. Ciba Specialty Chemicals Co. under the trade designation "Irganox L-135" and/or diphenyl amine available ex. Ciba Specialty Chemicals Co. under the trade designation "Irganox L-57" were used.

(d) Detergent

As outlined in Table 1, the detergent additives used in Examples 1, 2 and Comparative Examples B and C were a mixture of calcium alkylbenzene salicylate (neutral base) and calcium alkylbenzene salicylate (overbased).

The detergent additive used in Comparative Example A was a mixture of calcium phenate and calcium sulphonate.

(e) Other Additives

The lubricating oil compositions of Examples 1 and 2 and Comparative Examples A, B and C further comprised conventional quantities of dispersant, supplementary viscosity index modifier and anti-foaming agents typical of a conventional diesel engine crankcase lubricant.

(e) Base Oil

A Group III base oil was used which is available from Shell under the trade designation "XHVI".

Where a Group I base oil was also used, this base oil was a base oil or base oil mixture available under the trade designation "HVI" from Shell to give the appropriate viscosity grade.

The lubricating oil compositions that were prepared are indicated in Table 1.

TABLE 1

| | Example 1 | Example 2 | Comp. Example A | Comp. Example B | Comp. Example C |
|---|---|---|---|---|---|
| Viscosity grade (SAE) | 10W-30 | 10W-40 | 10W-40 | 10W-40 | 10W-40 |
| Base oil* | Group III | Group III | 25% Group III remainder Group I | 45% Group III remainder Group I | Group III |
| Supplementary Viscosity Index Modifier (wt. %) | No | Yes; concentrate contributes 3.7% w Group I diluent oil | Yes; concentrate contributes 5.3% w Group I diluent oil | Yes, concentrate contributes 13.5% w Group I diluent oil | Yes, concentrate contributes 6.6% w Group I diluent oil |
| Viscosity Index Modifier according to Formula I (wt. %) | 1.5 | 1.5 | 0 | 0 | 0 |
| Ca from Salicylate detergents (wt. %) | 0.24 | 0.24 | 0 | 0.47 | 0.24 |
| Ca from Phenate/Sulphonate detergents (wt. %) | 0 | 0 | 0.28 | 0 | 0 |
| Phosphorus from secondary ZnDTP (wt. %) | 0.06 | 0.05 | 0.12 | 0.12 | 0.05 |
| Succinimide dispersants*** | Yes | Yes | Yes | Yes | Yes |
| Phenolic antioxidants*** | Yes | Yes | Yes | No | Yes |
| Aminic antioxidants*** | Yes | Yes | No | No | Yes |
| Total Additive Package treat rate** (wt. %) | 14.4 | 14.4 | 17.6 | 19.5 | 14.4 |
| Total Sulphated ash (wt. %) (ASTM D874) | 0.9 | 0.9 | 1.2 | 1.85 | 0.9 |
| Total Sulphur (wt. %) (ASTM D2622) | 0.15 | 0.15 | 0.12 | 0.12 | 0.15 |
| Total Phosphorus (wt. %) (ICP-OES method) | 0.06 | 0.05 | 0.7 | 0.32 | 0.05 |
| Piston Cleanliness Rating DC OM441LA test (65 = Clean) | 41.3 | 45.3 | 26.1 | 40.4 | 36.9 |

*Balance of formulation.

**Package of additives containing detergents, dispersants, ZnDTP's and supplementary antioxidants plus carrier oil.

***Formulations wherein "yes" is specified contain similar amounts of the relevant components.

Test Method

Formulations were tested according to the known methodologies specified in DC OM441 LA engine test; CEC-L-52-T-97.

Results and Discussion

Example 1

An SAE 10W-30 lubricating oil composition as described in Table 1 was prepared in order to determine the effect of a low ash, low P, low S, salicylate containing formulation containing a compound according to formula I on engine piston cleanliness.

Supplementary anti-oxidants (i.e. "Irganox L-135" and "Irganox L-57") were added thereto in order to maintain the oxidation stability results from the reduced concentration of zinc dithiophosphate and detergent and to fully meet the requirements of the known API CI-4 specification.

The lubricating oil composition of Example 1 had a sulphated ash content of 0.9 wt. %, a phosphorus content of 0.06 wt. % and a sulphur content of 0.15 wt. %.

The SAE 10W-30 lubricating oil composition of Example 1 was tested as described above and the results are shown in Table 2.

TABLE 2

| | | MB 228.5 limits | Example 1 |
|---|---|---|---|
| Sludge | Min (merit) | 9.0 | 9.6 |
| Piston cleanliness | Min (merit) | 40.0 | 41.3 |
| General engine deposits rating | Max | 3.0 | 1.5 |
| Wear rating average | Max | 2.5 | 2.1 |
| Bore polishing | Max (%) | 2.0 | 2.0 |

TABLE 2-continued

| | | MB 228.5 limits | Example 1 |
|---|---|---|---|
| Average cylinder wear | Max (mm) | 0.008 | 0.002 |
| Ring sticking | ASF max | 1 | 0.42 |
| Boost press loss at 400 hours | Max (%) | 4.0 | 1.8 |
| Oil consumption | Max (kg) | 40.0 | 39.9 |

Table 2 above indicates the given limits of the highest DaimlerChrysler performance specification for heavy duty diesel engine oils which is known as "MB 228.5".

The piston cleanliness rating of 41.3 for the formulation of Example 1 (compared to a maximum possible clean rating of 65 for the method used) meets the requirement of the DaimlerChrysler specification MB 228.5.

This level of piston cleanliness performance can normally only be achieved by formulations containing much higher levels of metal containing detergent and therefore much higher levels of sulphated ash, as highlighted by the comparative examples discussed below.

It is also worth noting that this high level of piston cleanliness is achieved without a significant deficit in any other performance area with all the requirements of the MB 228.5 performance specification being satisfied.

Example 2

An SAE 10W-40 lubricating oil composition as described in Table 1 was prepared in order to determine the effect of a low ash, low phosphorus, low sulphur, salicylate containing formulation containing a compound according to formula I on engine piston cleanliness.

Supplementary anti-oxidants (i.e. "Irganox L-135" and "Irganox L-57") were added thereto in order to maintain the oxidation stability results from the reduced concentration of zinc dithiophosphate and detergent and to fully meet the requirements of the API CI-4 specification.

The lubricating oil composition of Example 2 had a sulphated ash content of 0.9 wt. %, a phosphorus content of 0.05 wt. % and a sulphur content of 0.15 wt. %.

The SAE 10W-40 lubricating oil composition of Example 2 was tested as described above and the results are shown in Table 3.

TABLE 3

| | | MB 228.5 limits | Example 2 |
|---|---|---|---|
| Sludge | Min (merit) | 9.0 | 9.3 |
| Piston cleanliness | Min (merit) | 40.0 | 45.3 |
| General engine deposits rating | Max | 3.0 | 1.5 |
| Wear rating average | Max | 2.5 | 2.1 |
| Bore polishing | Max (%) | 2.0 | 1.5 |
| Average cylinder wear | Max (mm) | 0.008 | 0.002 |
| Ring sticking | ASF max | 1 | 0 |
| Boost press loss at 400 hours | Max (%) | 4.0 | 0.5 |
| Oil consumption | Max (kg) | 40.0 | 33.4 |

The formulation of Example 2 has a wider span viscosity grade than the sample of Example 1, but the piston cleanliness rating of 45.3 (compared to a maximum possible clean rating of 65 for the test method used) is again very good (and directionally better) and meets the requirement of the highest DaimlerChrysler performance specification for heavy duty diesel engine oils, MB 228.5.

This level of piston cleanliness performance can normally only be achieved by formulations containing much higher levels of metal containing detergent and therefore much higher levels of sulphated ash, as highlighted by the comparative examples discussed below.

It is also worth noting that this high level of piston cleanliness is achieved without a significant deficit in any other performance area with all the requirements of the MB 228.5 performance specification being satisfied.

Comparative Example A

An SAE 10W-40 lubricating oil composition as described in Table 1 was prepared in order to determine the effect of a medium ash, high phosphorus, high sulphur, phenate/sulphonate detergent containing formulation (which does not contain a compound according to formula I) on engine piston cleanliness.

Sufficient phenolic supplementary anti-oxidant was added thereto in order to fully meet the requirements of the API CI-4 specification.

The lubricating oil composition of Comparative Example A had a sulphated ash content of 1.2 wt. %, a phosphorus content of 0.12 wt. % and a sulphur content of 0.7 wt. %.

The SAE 10W-40 lubricating oil composition of Comparative Example A was tested as described above and the results are shown in Table 4.

TABLE 4

| | | MB 228.5 limits | Comparative Example A |
|---|---|---|---|
| Sludge | Min (merit) | 9.0 | 9.6 |
| Piston cleanliness | Min (merit) | 40.0 | 26.1 |

TABLE 4-continued

| | | MB 228.5 limits | Comparative Example A |
|---|---|---|---|
| General engine deposits rating | Max | 3.0 | 1.6 |
| Wear rating average | Max | 2.5 | 1.6 |
| Bore polishing | Max (%) | 2.0 | 1.5 |
| Average cylinder wear | Max (mm) | 0.008 | 0.001 |
| Ring sticking | ASF max | 1 | 0.80 |
| Boost press loss at 400 hours | Max (%) | 4.0 | 0.3 |
| Oil consumption | max (kg) | 40.0 | 34.0 |

The piston cleanliness rating of 26.1 (compared to a maximum possible clean rating of 65 for the test method used) does not meet the requirement of the highest DaimlerChrysler performance specification for heavy duty diesel engine oils, MB 228.5.

Indeed, said formulation only just meets the requirement of the lower DaimlerChrysler performance specification, MB 228.3 (wherein a minimum piston cleanliness rating of 25.0 is specified).

Hence, even though the detergent level (ash level) is higher than in Examples 1 and 2, the switch to phenate/sulphonate detergents, a mixed Group I/III base stock mix and a higher ZnDTP content results in an inferior performance.

Comparative Example B

An SAE 10W-40 lubricating oil composition as described in Table 1 was prepared in order to determine the effect of a high ash, high phosphorus, medium sulphur, salicylate containing formulation not containing a compound according to formula I on engine piston cleanliness.

The lubricating oil composition of Comparative Example B had a sulphated ash content of 1.85 wt. %, a phosphorus content of 0.12 wt. % and a sulphur content of 0.32 wt. %.

The SAE 10W-40 lubricating oil composition of Comparative Example B was tested as described above and the results are shown in Table 5.

TABLE 5

| | | MB 228.5 limits | Comparative Example B |
|---|---|---|---|
| Sludge | Min (merit) | 9.0 | 9.5 |
| Piston cleanliness | Min (merit) | 40.0 | 40.4 |
| General engine deposits rating | Max | 3.0 | 1.4 |
| Wear rating average | Max | 2.5 | 1.4 |
| Bore polishing | Max (%) | 2.0 | 0.5 |
| Average cylinder wear | Max (mm) | 0.008 | 0.001 |
| Ring sticking | ASF max | 1 | 0.33 |
| Boost press loss at 400 hours | Max (%) | 4.0 | 2.4 |
| Oil consumption | Max (kg) | 40.0 | 23.5 |

The piston cleanliness rating of 40.4 (compared to a maximum possible clean rating of 65 for the test method used) meets the requirement of the highest DaimlerChrysler performance specification for heavy duty diesel engine oils, MB 228.5.

The high level of detergent and related high level of ash is typical of formulations meeting this high level of piston cleanliness performance. Indeed the high reference oil for this test (RL196) that is designed to meet the MB 228.5 level of performance is also a high ash, Group III based product.

It is therefore surprising that the low ash formulations such as Examples 1 and 2 of the present invention can satisfy this very demanding requirement.

Comparative Example C

An SAE 10W-40 lubricating oil composition as described in Table 1 was prepared in order to determine the effect of a formulation not containing a compound according to formula I on engine piston cleanliness.

The SAE 10W-40 lubricating oil composition of Comparative Example C was tested as described above and the results are shown in Table 6.

TABLE 6

| | | MB 228.5 limits | Comparative Example B |
|---|---|---|---|
| Sludge | Min (merit) | 9.0 | 9.58 |
| Piston cleanliness | Min (merit) | 40.0 | 36.9 |
| General engine deposits rating | Max | 3.0 | 1.37 |
| Wear rating average | Max | 2.5 | 1.38 |
| Bore polishing | Max (%) | 2.0 | 2.63 |
| Average cylinder wear | Max (mm) | 0.008 | 0.001 |
| Ring sticking | ASF max | 1 | 0.33 |
| Boost press loss at 400 hours | Max (%) | 4.0 | 0.8 |
| Oil consumption | Max (kg) | 40.0 | 34.6 |

It is of note that the piston cleanliness rating of the formulation of Comparative Example C does not meet the requirement of the highest DaimlerChrysler performance specification for heavy duty diesel engine oils, MB 228.5.

In contrast, the formulation of Example 2 which comprises 1.5 wt. % of a viscosity index modifier according to formula I, attains a piston cleanliness rating which meets the requirement of the DaimlerChrysler specification MB 228.5.

I claim:

1. A lubricating oil composition having a sulphur content of from 0.01 to 0.3 wt. %, a phosphorus content of from 0.01 to 0.1 wt. % and a sulphated ash content of from 0.1 to 1.2 wt. %, based on the total weight of the lubricating oil composition, comprising a mineral and/or synthetic base oil and at least one compound of formula I, (I)

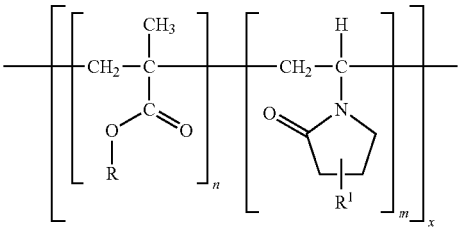

wherein R is an alkyl group containing from 3 to 50 carbon atoms; $R^1$ is hydrogen or an alkyl group containing from 1 to 50 carbon atoms; n is an integer equal to or greater than 1, and m is an integer equal to or greater than 1; and X is an integer from 2 to 10,000.

2. The lubricating oil composition of claim 1 wherein R is an alkyl group containing from 6 to 40 carbon atoms and $R^1$ is hydrogen or an alkyl group containing from 6 to 40 carbon atoms.

3. The lubricating oil composition of claim 1 wherein the compound of formula I is present in an amount in the range of from 0.01 to 10.00 wt. %, based on the total weight of the lubricating oil composition.

4. The lubricating oil composition of claim 1 wherein the composition further comprises at least one zinc dithiophosphate.

5. The lubricating oil composition of claim 4 wherein the zinc dithiophosphate is zinc dialkyl dithiophosphate.

6. The lubricating oil composition of claim 1 wherein the composition further comprises at least one salicylate detergent.

7. The lubricating oil composition of claim 1 wherein the composition further comprises at least one phenolic and/or aminic anti-oxidants.

8. The lubricating oil composition of claim 1 wherein the lubricating oil composition has a sulphated ash content in the range of 0.6 to 1.0 wt. %, based on the total weight of the lubricating oil composition.

9. The lubricating oil composition of claim 1 wherein said lubricating oil composition has a sulphur content in the range of 0.12 to 0.20 wt. %, based on the total weight of the lubricating oil composition.

10. The lubricating oil composition of claim 1 wherein said lubricating oil composition has a TBN value in the range of from 5.0 to 12.0 mg.KOH/g, as measured by ASTM D2896.

11. The lubricating oil composition of claim 1 wherein one of R and $R^1$ is a branched alkyl group.

12. The lubricating oil composition of claim 1 wherein one of R and $R^1$ is a straight chain alkyl group.

13. A method of lubricating an internal combustion engine, comprising introducing into the internal combustion engine a lubricating oil composition of claim 1.

* * * * *